US006959976B2

(12) United States Patent
Nelson et al.

(10) Patent No.: US 6,959,976 B2
(45) Date of Patent: Nov. 1, 2005

(54) HOT-MELT SEAL FOR NOZZLES ON PRINT CARTRIDGES AND METHOD

(75) Inventors: Veronica A. Nelson, Corvallis, OR (US); Melanie J Feder, Blodgett, OR (US); Terry M. Lambright, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 73 days.

(21) Appl. No.: 09/820,427

(22) Filed: Mar. 28, 2001

(65) Prior Publication Data

US 2002/0140763 A1 Oct. 3, 2002

(51) Int. Cl.[7] ..... B41J 2/165
(52) U.S. Cl. ..... 347/29
(58) Field of Search ..... 347/29.86, 22; 215/233; 220/359, 364; 229/123.1; 206/205

(56) References Cited

U.S. PATENT DOCUMENTS

| | | | | | |
|---|---|---|---|---|---|
| 4,490,925 | A | * | 1/1985 | Smith | 34/282 |
| 4,503,111 | A | * | 3/1985 | Jaeger et al. | 428/195 |
| 4,777,930 | A | * | 10/1988 | Hartz | 126/246 |
| 5,400,060 | A | * | 3/1995 | Carlotta | 347/29 |
| 5,521,002 | A | * | 5/1996 | Sneed | 428/331 |
| 5,701,995 | A | | 12/1997 | Higuma et al. | |
| 5,850,238 | A | * | 12/1998 | Karita et al. | 347/29 |
| 6,012,807 | A | | 1/2000 | Olsen et al. | |
| 6,034,712 | A | * | 3/2000 | Iwasaki | 347/241 |

FOREIGN PATENT DOCUMENTS

| | | | | | |
|---|---|---|---|---|---|
| JP | 405084925 | A | * | 4/1993 | 347/29 |

* cited by examiner

*Primary Examiner*—Shih-wen Hsieh

(57) ABSTRACT

Hot-melt Seal For Nozzles on Print Cartridges And Method. A layer of hot-melt is adhesively bonded to a print cartridge to seal the nozzles through which ink is jetted. In another aspect, a layer of hot-melt seals the electrical contacts and leads mounted on the print cartridge. The hot-melt adhesive can be either laminated with a moisture retardant (preferably impermeable) base film or block coated on moisture retardant (preferably impermeable) pouch material. These materials are thereafter adhesively bonded to the print cartridge, sealing the nozzles and preferably the electrical contacts and leads as well.

In one application process, a hot-melt moisture retardant laminate tape is cut to size, releasably captured, positioned over the nozzles, and heat staked to seal the nozzles of the print cartridge. In a second application process, a layer of hot-melt is directly applied over the nozzles and a layer of moisture retardant material is heat staked to the hot-melt. In a third application process, heat stakable pouch material is block coated with hot-melt, the block coated hot-melt is positioned over the nozzles and heat staked, and the print cartridge is thereafter flow wrapped. In a fourth application process a hot-melt, moisture retardant tape is cut to size and heat staked to seal the nozzles of a print cartridge. Thereafter a free-end of the tape is heat staked into a pouch material and then the print cartridge is flow wrapped with the pouch material.

18 Claims, 5 Drawing Sheets

FIG. 7
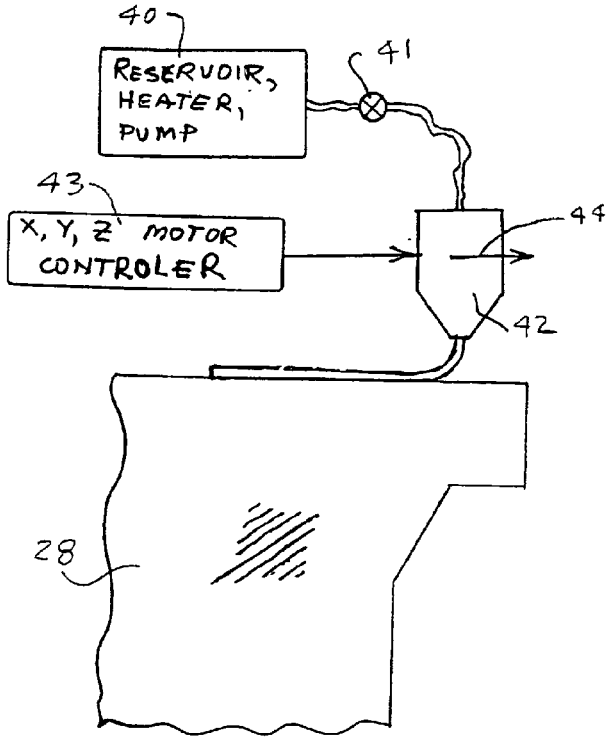
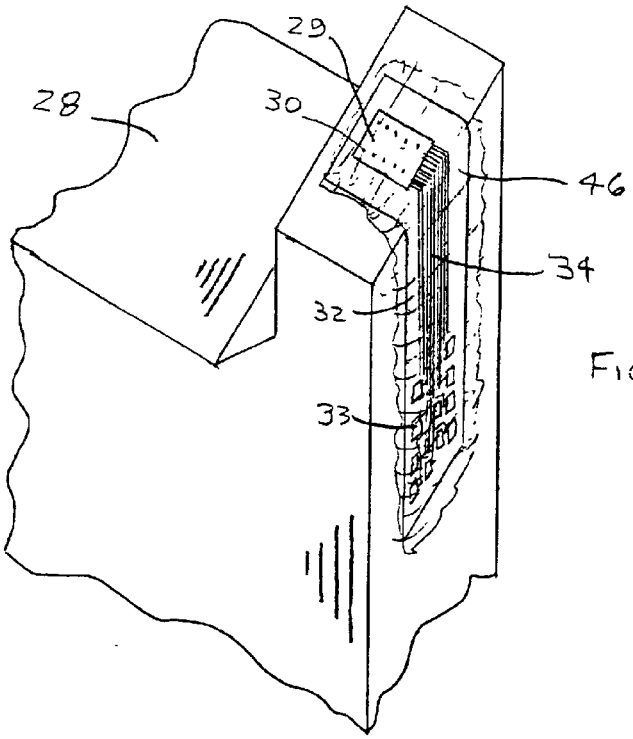
FIG. 8

HOT-MELT SEAL FOR NOZZLES ON PRINT CARTRIDGES AND METHOD

FIELD OF INVENTION

The present invention generally relates to print cartridges and, more particularly, to methods for sealing the nozzles on these print cartridges after manufacture and prior to use.

BACKGROUND OF THE INVENTION

A hot-melt adhesive is a fast-drying, thermoplastic polymer that is applied hot in a molten state to an adherend and forms an adhesive bond as it cools off. Adhesion is the physical attraction of the surface of one material for the surface of another. A hotmelt can have a pressure sensitive adhesive (PSA) character that allows for additional adhesion prior to the heat activated adhesion.

Print cartridges are devices that mark media in a printer under the control of a computer. Print cartridges have multiple nozzles that jet ink. Such cartridges include both thermal ink jet cartridges as well as piezoelectric cartridges.

Immediately after the manufacture of a print cartridge, the nozzles need be sealed to prevent the ink from leaking out of the print cartridge, from losing moisture, and from becoming contaminated. At the present time there are two common sealing methods in use. One is a pressure sensitive adhesive (PSA) tape that is applied to the surface of the orifice plate. One example of this tape is an polyvinyl chloride base tape with an acrylate adhesive applied on the surface of the tape. The other sealing method is an injected molded mechanical cap containing a piece of foam.

While these prior solutions have worked satisfactorily in the past, they are proving to be troublesome today because in each new model print cartridge, the ink is increasingly more corrosive and the size of the nozzle orifices is decreased.

In particular, the trend to more corrosive inks and to smaller orifice sizes has led to a problem with residue. If there is residue anywhere on the orifice plate, when the wiper that cleans the surface of the orifice plate sweeps across the surface of the orifice plate, the wiper will sweep that residue into the nozzles and clog them. Such residue can come from the adhesive on the nozzle sealing tape or from the migratory components in the base film. These components migrate through the adhesive and leach directly into the nozzles. Migratory components can also come from the plasticizers and other anti-oxidants in the base film.

Where formerly nozzles had a diameter of thirty (30) microns, today nozzles have a diameter of fifteen (15) microns and even smaller diameters are being contemplated. As the size of the nozzle bore has decreased, the capillary force in the bore has correspondingly increased. In other words, the smaller bores draw contaminants into the nozzles more effectively.

Further, there are increased problems with material incompatibility. The more corrosive inks attack the sealing materials on the surface of the orifice plate, resulting in the material degradation of these materials and the lowering of their adhesive's cohesive strength. Later, when the tape is removed for installation of the print cartridge in a printer, the tape tears or does not come off cleanly because of its weakened state. Another aspect of material incompatibility is the migration of materials out of the sealing tape adhesive and the base film. These materials travel down into the nozzles, precipitate some of the components in the ink, and cause plugs.

Moreover, there may develop a tent or bubble in the sealing tape if the force of adhesion to the print cartridge is not stronger than the force of the base film wanting to lift the tape off of the print cartridge at the point where the tape conforms over a feature on the print cartridge. The tent develops a pocket of air and ink will flow into the tent under the sealing tape. This ink will then attack the encapsulant protecting the electrical leads to the print head. Ultimately the corrosive ink will short out these leads and the print cartridge will fail.

In addition to the problems stemming from corrosive inks and nozzles with smaller bores, print cartridges are also subject to corrosion of the TAB circuit between the electrical contacts and the leads leading to the print head. Moisture permeates through the polyimide layer of the TAB circuit and corrodes the electrical leads. Such corrosion will ultimately lead to the shorting out of the electrical circuits leading to the print head and the failure of the print cartridge.

Thus, it will be apparent from the foregoing that although there are several ways for sealing print cartridges after manufacture, there is still a need for an approach that avoids ink leakage and contamination, residue on the orifice plate, and corrosion of the electrical contacts and leads attached to a print cartridge.

SUMMARY OF THE INVENTION

Briefly and in general terms, an apparatus according to the invention includes a print cartridge having nozzles through which ink is jetted and a layer of hot-melt adhesively bonded to the print cartridge that seals the nozzles. In another aspect of the invention a layer of hot-melt seals the electrical contacts and leads mounted on the print cartridge.

Further, a hot-melt adhesive can be either laminated with a moisture retardant base film or block coated on a moisture retardant pouch material. These materials are thereafter adhesively bonded to the print cartridge, sealing the nozzles and preferably the electrical contacts and leads as well.

In one application process, a hot-melt moisture retardant laminate tape is cut to size, releasably captured, positioned over the nozzles, and heat staked to seal the nozzles of the print cartridge. In a second application process, a layer of hot-melt is applied over the nozzles and a layer of moisture retardant material is heat staked to the hot-melt. In a third application process, heat stakable pouch material is block coated with hot-melt, the block coated hot-melt is positioned over the nozzles and heat staked, and the print cartridge is thereafter flow wrapped. In a fourth application process, a hot-melt, moisture retardant tape is cut to size and heat staked to seal the nozzles of a print cartridge. Thereafter, a free-end of the tape is heat staked into a pouch material, and then the print cartridge is flow wrapped with the pouch material.

Other aspects and advantages of the invention will become apparent from the following detailed description, taken in conjunction with the accompanying drawings, illustrating by way of example the principles of the invention.

BRIEF DESCRIPTION OF THE DRAWINGS

FIG. 7 is a diagrammatic, side elevational view of a process for applying a layer of molten hot-melt directly onto a print cartridge.

FIG. 8 is a perspective view, partially cut away, of the print cartridge of FIG. 7 after the hot-melt is applied.

DESCRIPTION OF THE PREFERRED EMBODIMENTS

Figure 1:
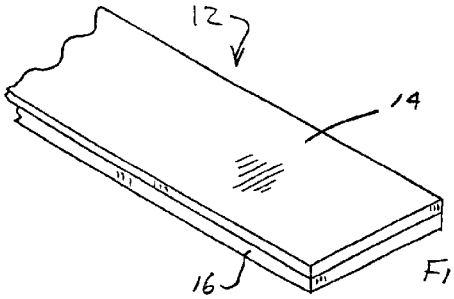
FIG. 1 is a perspective view, partially cut away, of a laminate for sealing the nozzles on print cartridges embodying the principles of the invention.

As shown in the drawings for the purposes of illustration, the invention is embodied in a laminate for sealing nozzles on print cartridges that comprises a moisture retardant base film and a layer of hot-melt that is adhesively bonded to the film. In an other aspect, a layer of hot-melt is adhesively bonded to the print cartridge to seal the nozzles. Later, a moisture retardant film can be heat staked to the hot-melt.

The invention offers a simple solution that is inexpensive and durable. The materials available from the flexible hot-melt family of polymers is broad and their chemistry is well understood. For these applications moisture retardance is also necessary so that moisture from the ink does not evaporate through sealing materials and cause coagulation of the ink around the nozzles.

Referring to FIG. 1, reference numeral 12 generally indicates a laminate for sealing nozzles on print cartridges. The laminate 12 is a two layer system including a base film 14 and a layer 16 of hot-melt. The base film is a thin film, about 1–2 mils thick, chosen for its moisture retardance (preferably impermeability) as well as conformability to any gross topography on the print cartridge. The base film can be any polyolefin such as polypropylene or polyethylene or any polyester such as PET. The base film has three functions: moisture barrier, base for the adhesive layer, and means for removal of the hot-melt from the nozzles just prior to the installation of the print cartridge.

Referring to FIG. 1, reference numeral 16 indicates a layer of hot-melt adhesive. The hot-melt is laid in a thin layer on the base film. The hot-melt is flexible and can be any polyolefin or synthetic elastomeric material that meets or exceeds the characteristics described here. The hot-melt is a low tack material that can be easily removed from the print cartridge prior to installation in a printer and will not leave any residue behind on the orifice plate. The hot-melt must be chemically compatible with the inks so it does not chemically contaminate the inks and the inks do not contaminate it. The hot-melt serves four functions: seals the orifices that jet ink, prevents ink from escaping from the print cartridge, prevents ink from attacking any of the materials around the orifice plate, and provides corrosion resistance because it acts as a moisture barrier.

In one embodiment of the laminate actually constructed 1.5 mil Nucrel®, available from the E.I. duPont de Nemours and Company of Wilmington, Del., was put on PET by Minnesota Mining and Manufacturing Company (3M) of St. Paul, Minn. and used as the base-film. An EVA material, stock number AHS-413, available from 3M, was used for the hot-melt.

In another embodiment actually constructed a pouch material, Bicor 100 LBW, available from Mobile Chemical Company of Fairfax, Va., was used with a synthetic rubber hot-melt, stock number NS 122-12, available from National Starch and Chemical Company, Bridgewater, N.J.

The laminate 12 can also be a non-woven base film having crevices and a moisture retardant hot-melt placed on the base film so that the hot-melt flows into the crevices and the laminate is thus adhesively and mechanically bonded together. In an embodiment actually constructed the synthetic rubber hot-melt, stock number NS 122-12, available from National Starch and Chemical Company and the base film, Tyvek®, available from the E.I. duPont de Nemours and Company of Wilmington, Del. were used.

Figure 2:
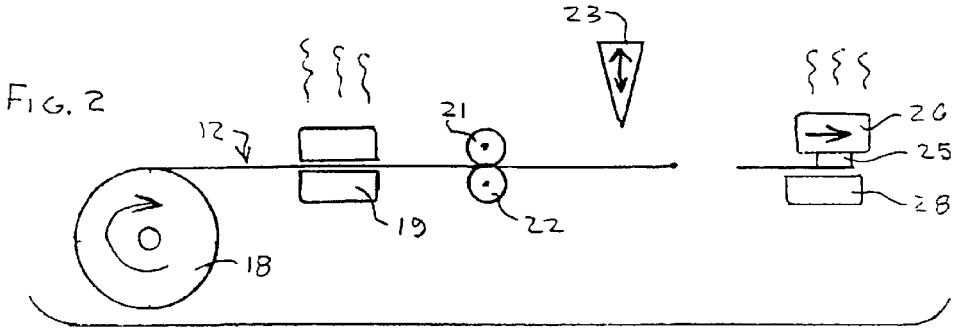
FIG. 2 is a diagrammatic view of a process for sealing print cartridges using the laminate of FIG. 1.

FIG. 2 illustrates a diagrammatic view of a process and apparatus for sealing print cartridges using the laminate 12, FIG. 1. The apparatus includes a reel 18 for holding the hot-melt laminate and for dispensing the laminate as needed during manufacturing. The reel spools the laminate 12 into a pair of pre-heating elements 19 that warm the laminate so when the laminate reaches the heat staker further down the manufacturing line, the laminate does not need to be heated as much and product thru-put can be maximized. The pre-heating elements 19 heat the laminate to about 212° F./100° C. depending on process requirements.

Referring to FIG. 2, reference numeral 21 indicates a drive roller 21 that spools the laminate off of the reel 18, and 22 indicates an idler roller that keeps the laminate in alignment and eliminates any twists or slack. Reference numeral 25 indicates a vacuum chuck 25 for capturing the laminate to be cut. The vacuum chuck moves in three dimensions. After capture, a cutter or slitting mechanism 23 cuts the laminate to its required size. Within the vacuum chuck 25 is a heater 26 that brings the laminate up to the temperature required for staking, about 248° F./120° C. or lower, while the vacuum chuck 25 is positioning the cut laminate over a print cartridge 28. After the cut laminate is in position and up to temperature, the vacuum chuck stakes the laminate to the print cartridge 28.

Depending on the product thru-put and the operation of the vacuum chuck 25, the hot-melt adhesive may or may not need some tackiness to hold the cut laminate in position on the print cartridge 28 until the hot-melt cools sufficiently to adhesively bond to the print cartridge 28.

Figure 6:
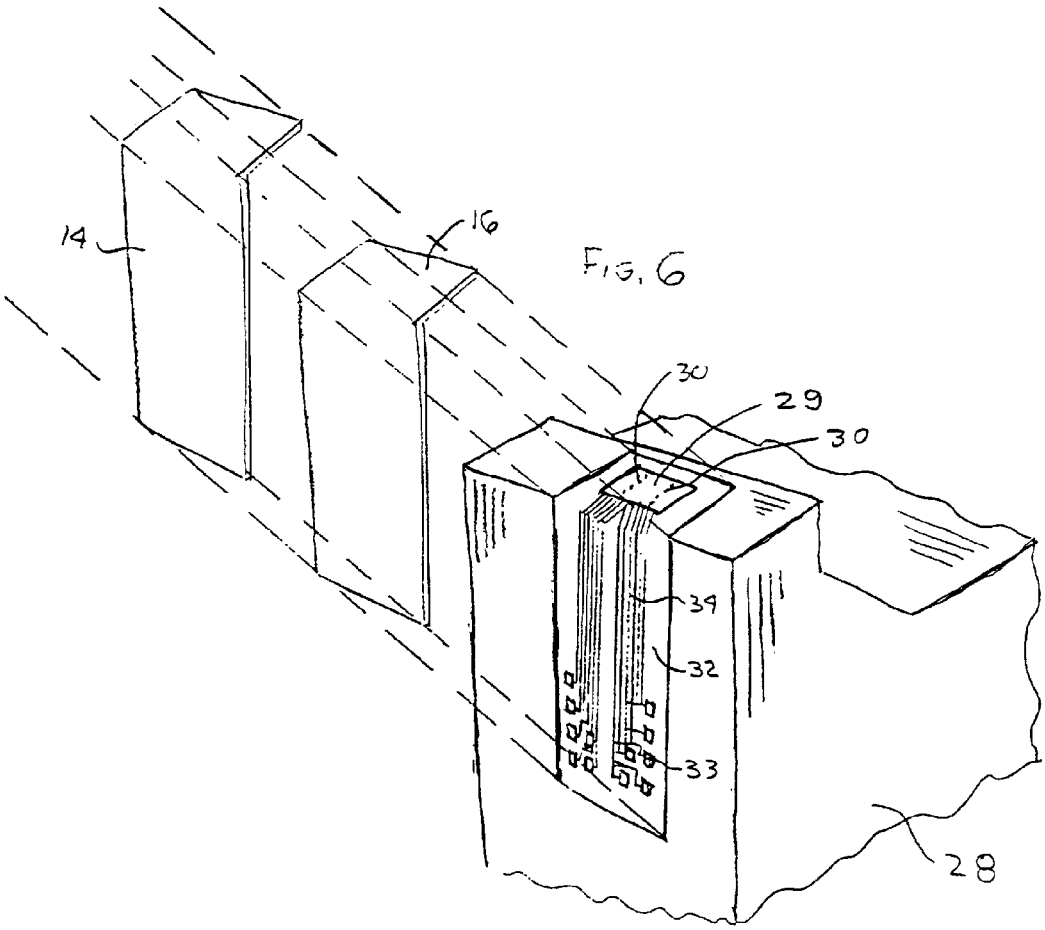
FIG. 6 is an exploded, perspective view, partially cut away, of the print cartridge of FIG. 5.

Referring to FIG. 6, reference numeral 28 indicates a conventional ink jet print cartridge. The print cartridge includes an orifice plate 29 having an array of nozzles 30 that jet ink. Also located on the print cartridge is a TAB circuit 32 containing a plurality of electrical contacts 33 and leads 34 that electrically connect the printer, not shown, to the print head of the print cartridge. The TAB circuit is fabricated from a polyimide and the traces and contacts, from a metal alloy.

Figure 3:
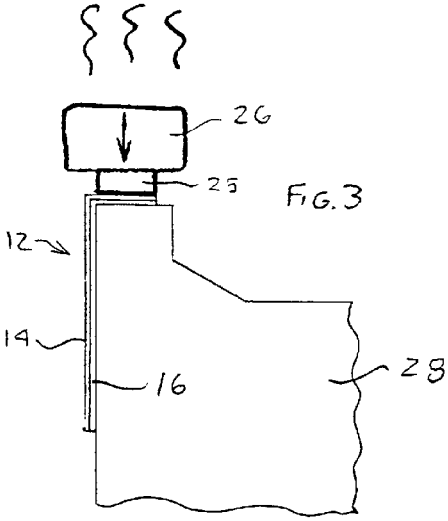
FIGS. 3 and 4 are diagrammatic views of additional steps in the process of FIG. 2.
Figure 4:
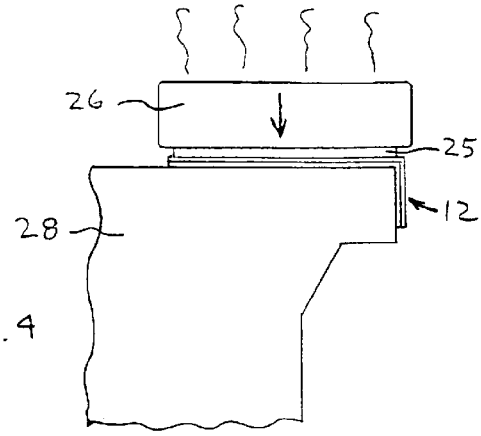
Figure 5:
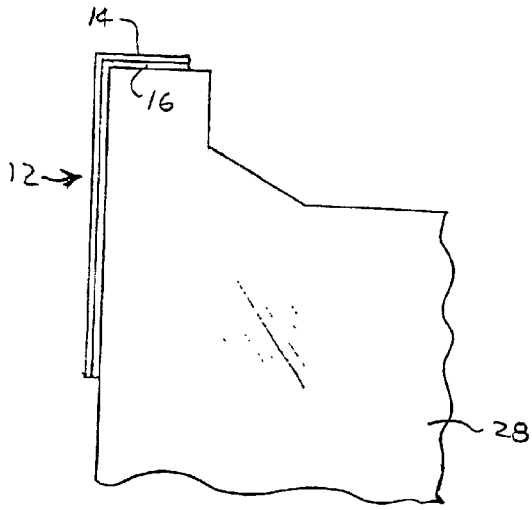
FIG. 5 is a side elevational view, partially cut away, of a print cartridge sealed with the laminate of FIG. 1.

FIG. 3 illustrates the Heated Staking Station where the vacuum chuck 25 is heat staking one end of the laminate film 12 over the orifice plate 29, FIG. 6, containing the nozzles 30. FIG. 4 illustrates the Full-flex Stake Station where the vacuum chuck 25 is heat staking the other end of the laminate film 12 over the electrical contacts 33, FIG. 6, and leads 34. FIG. 5 illustrates the print cartridge 28 after the laminate film has adhesively bonded to it, thereby sealing the nozzles, the electrical contacts, and the leads. This is the Full-wrap Tape embodiment.

FIGS. 7–10 illustrate an alternative embodiment for sealing a print cartridge by dispensing molten hot-melt directly onto the print cartridge.

Referring to FIG. 7, reference numeral 40 indicates a conventional hot-melt reservoir that has an internal heater and a pump. The reservoir is connected to a heated hose which in turn is connected to a gun 41 that meters the amount of hot-melt that flows into a dispenser 42. The dispenser has an elongated, rectangular, horizontal, slotted nozzle that has a longitudinal axis perpendicular to the arrow 44. The arrow 44 indicates the direction of motion of the dispenser 42 in FIG. 7 and is the axis of hot-melt lay down. The dispenser lays down a layer of hot-melt directly onto the print cartridge. In FIG. 7 the dispenser 42 is putting down a layer that covers the electrical contacts 33, FIG. 6, and the leads 34. The dispenser 42 is moved in the X, Y, and Z axes by a conventional motor controller 43.

Referring to FIG. 8, the print cartridge 28 and the dispenser 42 are translated with respect to each other so that a layer 46 of hot-melt is put down from one end of the orifice plate 29 to the other, covering all of the nozzles 30. The hot-melt can be extended over the entire TAB circuit 32, covering all of the contacts 33 and all of the leads 34. Since the hot-melt is engineered to be removed prior to use of the print cartridge 28, as much surface area and as many components of the print cartridge as desired can be covered. FIG. 8 illustrates the hot-melt layer 46 after application.

Figure 9:
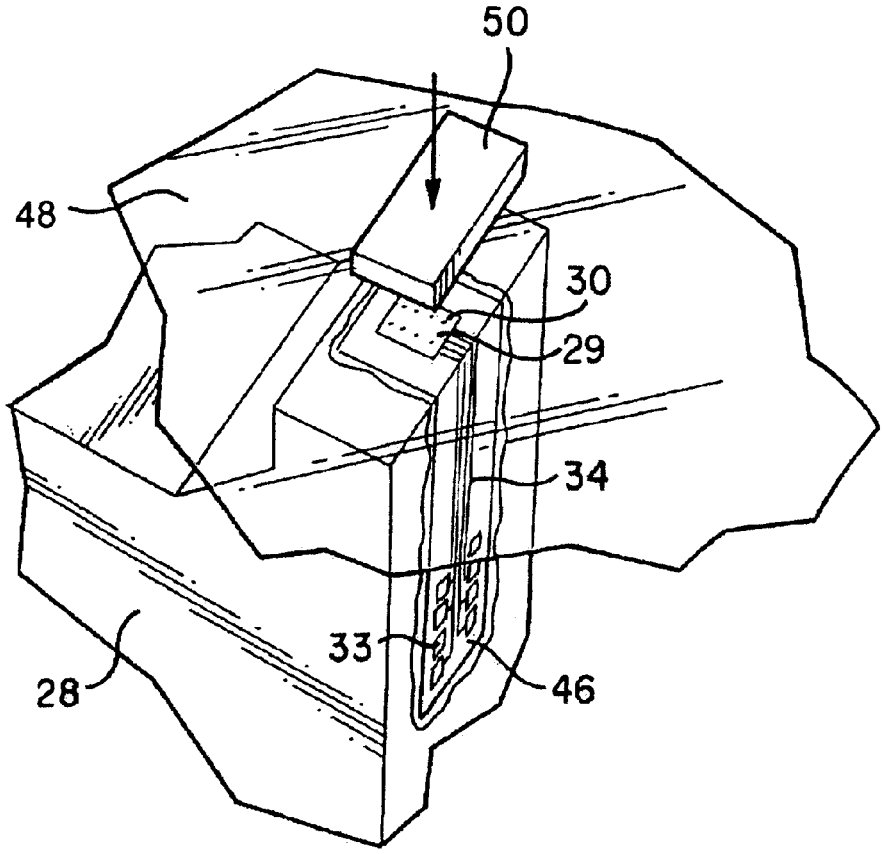
FIG. 9 is a perspective view, partially cut away, of the print cartridge of FIG. 7 just prior to heat staking a moisture retardant, heat stakable, pouch material to the hot-melt.
Figure 10:
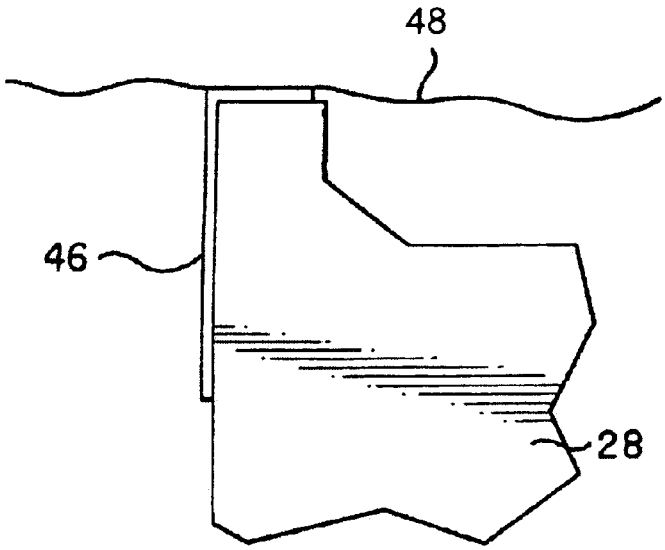
FIG. 10 is a side elevational view of the print cartridge of FIG. 9 after the moisture retardant layer of material is heat staked to the hot-melt.

Referring to FIG. 9, after the layer 46 of hot-melt has adhesively bonded to the print cartridge 28, a film 48 is heat staked to the hot-melt by a translating hot plate 50. FIG. 10 illustrates the print cartridge 28 after the film 48 has been heat staked into place. The film is preferably a pouch material but can also be a base film as well; so long as the film is moisture retardant (preferably impermeable) and has conformability. The film preferably conforms to any topography on the surface of the print cartridge. In either case the film 48 should have a greater adhesion to the hot-melt than the hot-melt has to the print cartridge 28 so that the hot-melt can be removed from the print cartridge by pulling away the film 48.

Pouch material or pouch film can be any heat stakable film that protects the print cartridge from contamination after assembly and before installation in a printer. Preferably a pouch material such as Bicor 100 LBW available from Mobile Chemical Company of Fairfax, Va., can be used.

It is also contemplated that the hot-melt layer on the print cartridge can be heat staked to a shipping container, a cardboard sleeve, or a packing box as long as the relative adhesions described above between the print cartridge, the hot-melt, and the container are maintained.

It may also be preferable to use a foil film so that the film will have ESD, electrostatically dissipating, qualities.

Heat staking the film 48 to the hot-melt can occur immediately after the hot-melt has been applied to the print cartridge or any time later during the print cartridge assembly process since the nozzles have already been sealed.

While the use of a film 48 is preferable, it is contemplated that the film may not be necessary if a hot-melt having the characteristics described above is used.

Figure 11:
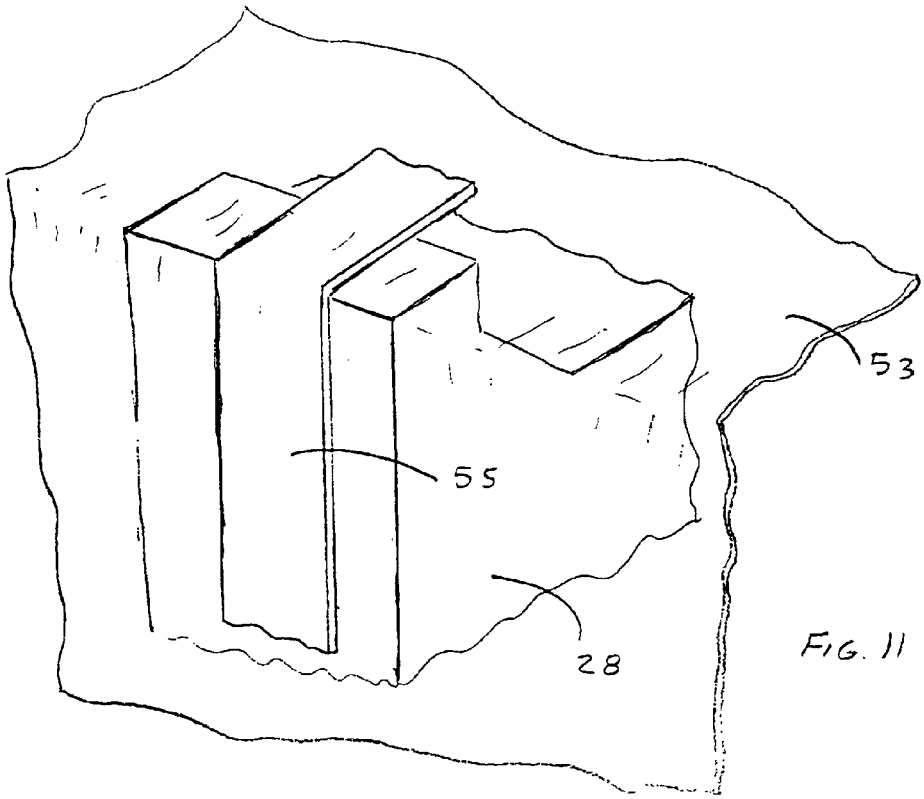
FIG. 11 is a perspective view, partially cut away, of a print cartridge sealed with a block coated hot-melt on heat stakable pouch material.

FIG. 11 illustrates a print cartridge 28 sealed with a block coated hot-melt 55 on heat stakable pouch material 53. The block coating is a pattern of hot-melt coated onto a base film before the nozzle sealing process is commenced. The clock coating is a strip of hot-melt sufficiently wide to cover the width of the orifice plate 29, FIG. 6. The base film is a heat stakable pouch material. The pouch material and the hot-melt are chosen for their moisture retardance (preferably impermeability) as well as conformability to any gross topography on the print cartridge. The hot-melt is heat staked to the print cartridge 28 in the same manner as described above in connection with FIGS. 3 and 4. After sealing the orifice plate 29, FIG. 6, and the TAB circuit 32, the pouch material 53 is flow wrapped around the print cartridge 28 into a pouch and heat staked. Later, when the print cartridge is to be installed in a printer, the pouch material 53 is removed from around the print cartridge 28. This removal of the pouch material also pulls the block coated hot-melt off of the orifice plate because the hot-melt does not separate from the pouch material. This construction allows for all-in-one, simultaneous pouch and nozzle seal removal.

In an embodiment actually constructed the hot-melt was a synthetic rubber material, stock number NS122-12, available from National Starch and Chemical Company, and the heat stakable pouch material was Bicor 100 LBW available from Mobile Chemical Company of Fairfax, Va.

Figure 12:
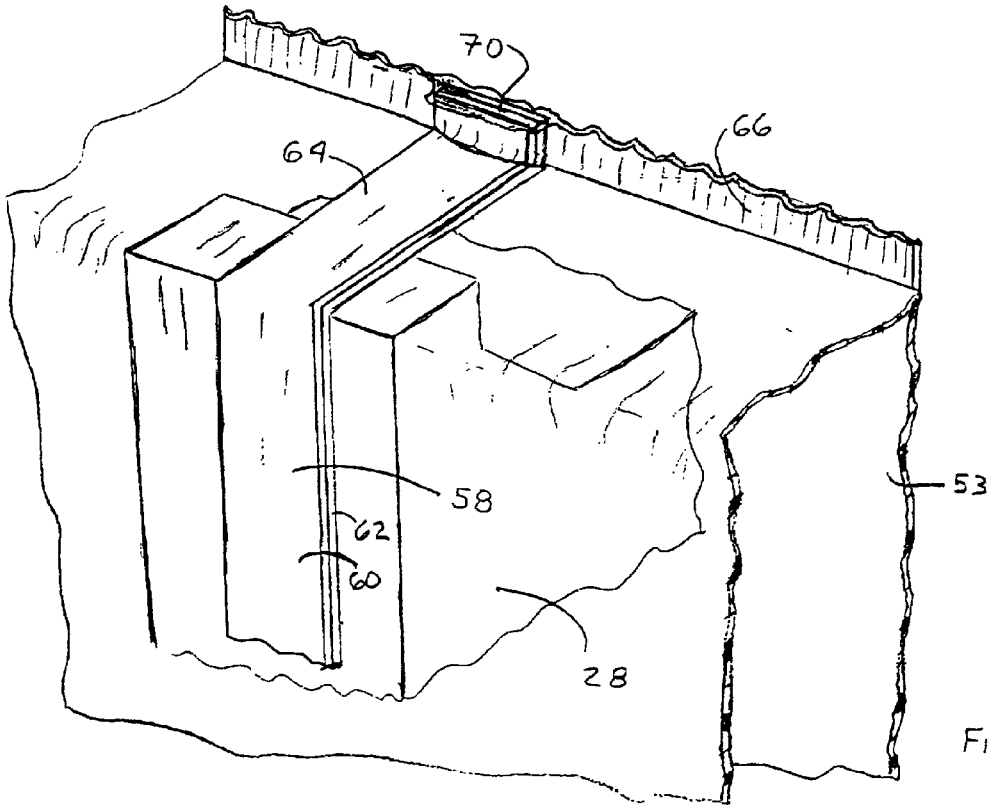
FIG. 12 is a perspective view, partially cut away, of a print cartridge having nozzles that are sealed with a hot-melt laminate, the laminate having a free-end that is heat sealed into the pouch material prior to flow wrapping the print cartridge.

FIG. 12 illustrates an alternative embodiment for sealing the nozzles on a print cartridge 28. Reference numeral 58 indicates a laminate having a base film 60 and a hot-melt layer 62. The base film is fabricated from the same material as the pouch material 53. The hot-melt is one of the adhesives described above. The laminate is applied to the print cartridge in the same manner as described above. The laminate 58 has a free-end 64 that is captured in the crimped heat seal 66 of the pouch material 53 before the pouch is formed around the print cartridge 28 by flow wrapping. Reference numeral 70 indicates the capture point. In other words, the free-end 64 is heat sealed into the pouch material. Later, when the print cartridge 28 is to be installed in a printer, the pouch material 53 is removed from around the print cartridge 28. This removal of the pouch material also pulls the laminate 58 off of the orifice plate because the laminate 58 does not separate from the pouch material 53. This construction allows for all-in-one, simultaneous pouch and nozzle seal removal, i.e., fail proof removal of the nozzle seal.

Although specific embodiments of the invention have been described and illustrated, the invention is not to be limited to the specific forms or arrangement of parts so described and illustrated. In particular, this invention has application for sealing both piezoelectric and thermal ink jet nozzles and electrical contacts. The invention is limited only by the claims.

We claim:

1. A laminate for sealing nozzles on point cartridges, comprising:

a moisture retardant base film; and a hot-melt layer adhesively bonded thereto, the laminate seals the print cartridge nozzles prior to use, wherein the laminate additionally contacts and seals electrical contacts and leads on print cartridges against corrosion.

2. The laminate of claim 1, wherein the base film is a polyethylene terephthalate film coated with an ethylene acid copolymer resin.

3. The laminate of claim 1, wherein the base film is an oriented propylene film.

4. The laminate of claim 1, wherein the base film is a spunbonded olefin film.

5. A laminate for sealing print cartridges, comprising:

a non-woven thin base film having crevices therein; and a moisture retardant hot-melt layer, said hot-melt flows into the crevices in the base film and mechanically bonds the film and hot-melt layer together.

6. A print cartridge with sealed nozzles, comprising:

a print cartridge having nozzles through which ink is jetted; and a hot-melt layer adhesively bonded to the print cartridge and sealing the nozzles, wherein the hot-melt layer bonds the print cartridge to a package containing the print cartridge.

7. The print cartridge of claim 6 wherein the print cartridge contains ink; the nozzles are contained in an orifice plate on the print cartridge; and the hotmelt prevents ink from escaping from the print cartridge, prevents ink from attacking materials around the orifice plate, and provides a moisture barrier against corrosion.

8. The print cartridge of claim 6 wherein the print cartridge has electrical contacts and leads mounted thereon which are also sealed by the hot-melt.

9. The print cartridge of claim 6 wherein the hot-melt is adhesively bonded to a film having an adhesion with the hot-melt that is greater than the adhesion between the hot-melt and the print cartridge.

10. The print cartridge of claim 6 wherein the hot-melt layer is laminated with a moisture retardant base film.

11. The print cartridge of claim 6 where in the hot-melt is heat staked to a moisture retardant pouch material.

12. The print cartridge of claim 6 where in the hot-melt is heat staked to a cardboard sleeve.

13. The print cartridge of claim 6 wherein the hot-melt is block coated on heat stakable pouch material.

14. The print cartridge of claim 6 wherein pouch material is wrapped around the print cartridge and wherein the hot-melt layer is one layer of a laminate, said laminate having a free-end that is captured in the pouch material.

15. A process for sealing a print cartridge having nozzles that jet ink, comprising:

releasably capturing a hot-melt moisture retardant tape;

cutting the tape to size;

positioning the cut tape over the nozzles; and heat staking the tape over the nozzles, wherein the tape has a free end and capturing the free end of the tape in pouch material and flow wrapping the pouch material around the print cartridge.

16. A process for sealing a print cartridge having nozzles that jet ink, comprising:

releasably capturing a hot-melt moisture retardant tape;

cutting the tape to size;

positioning the cut tape over the nozzles; and heat staking the tape over the nozzles, wherein the print cartridge has electrical contacts and leads and further including positioning the cut tape over the electrical contacts and leads as well as the nozzles and heat staking the tape over and in contact with the electrical contacts and leads as well as the nozzles.

17. A process for sealing a print cartridge having nozzles that jet ink, comprising;

block coating heat stakable pouch material with hotmelt;

positioning the pouch material over the nozzles;

heat staking the block coated hot-melt to the nozzles; and flow wrapping the pouch material around the print cartridge.

18. The process of claim 17, wherein the print cartridge has electrical contacts and leads and further including:

positioning the block coated hot-melt over the electrical contacts and leads as well as the nozzles; and heat staking the block coated hot-melt over the electrical contacts and leads.

* * * * *

UNITED STATES PATENT AND TRADEMARK OFFICE

CERTIFICATE OF CORRECTION

PATENT NO. : 6,959,976 B2
APPLICATION NO. : 09/820427
DATED : November 1, 2005
INVENTOR(S) : Nelson et al.

It is certified that error appears in the above-identified patent and that said Letters Patent is hereby corrected as shown below:

Column 6, line 2, delete “clock” and insert therefor --block--.

Claim 1, Column 6, line 55, delete “point” and insert therefor --print--.

Col. 8, line 38, insert the following claims:

--19. A print cartridge system, comprising:
a print cartridge including nozzles through which ink is jetted;
a seal attached to the print cartridge and disposed over the nozzles, the seal being adhesively attached to the print cartridge and forming a moisture impermeable barrier over each nozzle preventing flow of ink and moisture out of each nozzle, wherein the seal comprises a hot melt adhesive layer adhesively attached to the print cartridge and forming a barrier over each nozzle preventing flow of ink out of each nozzle, and the seal further comprises a non-woven base film attached to the hot melt adhesive layer.

20. The print cartridge system of claim 19, wherein the hot melt adhesive layer is moisture retardant and forms a moisture impenetrable barrier over each nozzle preventing flow of ink and moisture out of each of the nozzles.

21. The print cartridge system of claim 20, wherein the hot melt adhesive layer is a moisture retardant synthetic rubber hot melt adhesive layer.

22. The print cartridge system of claim 19, wherein the non-woven base film has crevices and the hot melt adhesive layer includes hot melt adhesive material disposed on the crevices of the non-woven base film.

23. The print cartridge system of claim 19, wherein the non-woven base film is a spunbonded olefin film.

24. A print cartridge system, comprising:
a print cartridge including nozzles through which ink is jetted;
a seal attached to the print cartridge and disposed over the nozzles, the seal being adhesively attached to the print cartridge and forming a moisture impermeable barrier over each nozzle preventing flow of ink and moisture out of each nozzle, wherein the seal comprises a hot melt adhesive layer adhesively attached to the print cartridge and forming a barrier over each nozzle preventing flow of ink out of each nozzle, and the seal further comprises a moisture retardant base film disposed over the hot melt adhesive layer.

UNITED STATES PATENT AND TRADEMARK OFFICE

CERTIFICATE OF CORRECTION

PATENT NO. : 6,959,976 B2
APPLICATION NO. : 09/820427
DATED : November 1, 2005
INVENTOR(S) : Nelson et al.

It is certified that error appears in the above-identified patent and that said Letters Patent is hereby corrected as shown below:

25. The print cartridge system of claim 24, wherein the hot melt adhesive layer is a polyolefin layer.

26. The print cartridge system of claim 24, wherein the hot melt adhesive layer is a synthetic elastomeric material.

27. The print cartridge system of claim 24, wherein the hot melt adhesive layer is an ethyl vinyl acetate (EVA) hot melt adhesive layer.

28. The print cartridge system of claim 24, wherein the moisture retardant base film is adhesively attached to the hot melt adhesive layer.

29. The print cartridge system of claim 24, wherein the base film is a moisture retardant polyolefin film.

30. The print cartridge system of claim 29, wherein the base film is a polypropylene film.

31. The print cartridge system of claim 29, wherein the film is a polyethylene film.

32. The print cartridge system of claim 24, wherein the base film is a polyethylene terephthalate film and the hot melt adhesive layer is an ethylene acid copolymer resin coated on the base film.

33. The print cartridge system of claim 24, wherein the base film forms a sealed pouch enclosing the print cartridge.

34. The print cartridge system of claim 24, wherein the base film comprises multiple layers.

35. The print cartridge system of claim 34, wherein the base film comprises a first film layer coated with a second film layer.

36. The print cartridge system of claim 35, wherein the base film comprises a polyethylene terephthalate film coated with an ethylene acid copolymer resin, and the hot melt adhesive layer is an ethyl vinyl acetate (EVA) hot melt adhesive layer.

UNITED STATES PATENT AND TRADEMARK OFFICE

CERTIFICATE OF CORRECTION

PATENT NO. : 6,959,976 B2
APPLICATION NO. : 09/820427
DATED : November 1, 2005
INVENTOR(S) : Nelson et al.

It is certified that error appears in the above-identified patent and that said Letters Patent is hereby corrected as shown below:

37. A print cartridge system, comprising:

a print cartridge including nozzles through which ink is jetted;

a seal attached to the print cartridge and disposed over the nozzles, the seal being adhesively attached to the print cartridge and forming a moisture impermeable barrier over each nozzle preventing flow of ink and moisture out of each nozzle;

wherein the print cartridge includes electrical contacts and the seal contacts the electrical contacts and forms a moisture impenetrable barrier over the electrical contacts.

38. A print cartridge system, comprising:

a print cartridge including nozzles through which ink is jetted;

a seal attached to the print cartridge and disposed over the nozzles, the seal being adhesively attached to the print cartridge and forming a moisture impermeable barrier over each nozzle preventing flow of ink and moisture out of each nozzle;

wherein the print cartridge includes electrical leads and the seal contacts the electrical leads and forms a moisture impenetrable barrier over the electrical leads.--

Signed and Sealed this

Twenty-seventh Day of October, 2009

David J. Kappos

David J. Kappos
*Director of the United States Patent and Trademark Office*